United States Patent [19]

Chong

[11] Patent Number: 4,833,865

[45] Date of Patent: May 30, 1989

[54] CAN CLEANING SYSTEM

[76] Inventor: Wun C. Chong, 63 Wallace Place, Delta, British Columbia V4M 3S2, Canada

[21] Appl. No.: 129,762

[22] Filed: Dec. 7, 1987

[51] Int. Cl.[4] ..... B65B 63/00

[52] U.S. Cl. ..... 53/517

[58] Field of Search ..... 53/513, 514, 515, 517, 53/519, 527, 435; 83/303, 411 R, 411 A

[56] References Cited

U.S. PATENT DOCUMENTS

| | | | |
|---|---|---|---|
| 2,444,502 | 7/1948 | Fromer | 53/515 X |
| 3,181,957 | 5/1965 | Carruthers | 53/517 X |
| 3,771,284 | 11/1973 | Boeckmann et al. | 53/282 |
| 4,642,971 | 2/1987 | Gilkey | 53/435 |

*Primary Examiner*—Robert L. Spruill
*Assistant Examiner*—Beth Tenney
*Attorney, Agent, or Firm*—Fetherstonhaugh & Co.

[57] ABSTRACT

Apparatus to trim the contents of a container projecting from the container top. The apparatus has a central, fixed shaft. A table is rotatably mounted on the shaft. Container receiving platforms can rotate on the table. The platforms can be raised and lowered. Rotatable cutters are located above the table, axially aligned with the platforms. A container on the table can be rotated as the table rotates and the platform can be raised towards the cutters to allow the cutters to contact the container top to trim the projecting contents.

26 Claims, 4 Drawing Sheets

152
18
20
8
150
146
156
154
30
148
86
2
40
60
28
20
34
36
144
32
56
52
46
58
40
14
12
50
125
122
90
54
48
24
22
140
16
88
56
44
58
142
38
143
126
120
70
106
66
20
115
118
86
2
40
26
60
68

125
136
134
136
126
138
128
118
120
130
132
115
96
86
92
82
94
88
80
84
78
113
116
111
2
98
101
100
40
99
104
22
26
73
102
56
54
44
42
75
60
74
70
18
64
58
76
114
72
110
106
108
112
76
66
68

CAN CLEANING SYSTEM

FIELD OF THE INVENTION

This invention relates to an apparatus to trim the contents of a container projecting from the container top.

In the canning of food, it is important that the canning be done properly and, in particular, that the sealing of the can be carried out effectively. The seal must be completely airtight. Failure to provide an airtight seal can be disastrous. In particular, botulism can result from imperfect sealing of cans of food.

DESCRIPTION OF THE PRIOR ART

A frequent source of trouble in sealing a can is that the contents of the can extend over the edge of the can after the can has been filled, usually on a production line, with a measured amount of food. In fish packing in particular bones and skin can project over the edge of the can and interfere with the subsequent sealing of the can.

There are a number of pieces of equipment that can trim the projecting contents of a can prior to the lid being sealed on the can in an airtight manner. However, there is a constant search for improved results. Improved results mean a faster rate of production, coupled with a low rejection rate.

The present invention seeks to provide a piece of equipment that, in tests conducted, has provided an extremely rapid rate of trimming coupled with an extremely high proportion of acceptable seals, subsequent to the trimming operation.

SUMMARY OF THE INVENTION

Accordingly, the present invention is an apparatus to trim the contents of a container projecting from the container top, the apparatus comprising:

a central, fixed shaft;

a table rotatably mounted on the shaft;

a plurality of container receiving platforms rotatably mounted on the table;

means to raise and lower said platforms;

a plurality of rotatable cutting means located above the table, each axially aligned with a platform;

whereby a container on said table can be rotated as the table rotates and the platform can be raised towards the cutting means to allow the cutting means to contact the container top to trim the projecting contents.

DESCRIPTION OF THE DRAWINGS

Aspects of the invention are illustrated, merely by way of example, in the accompanying drawings in which.

Figure 1:
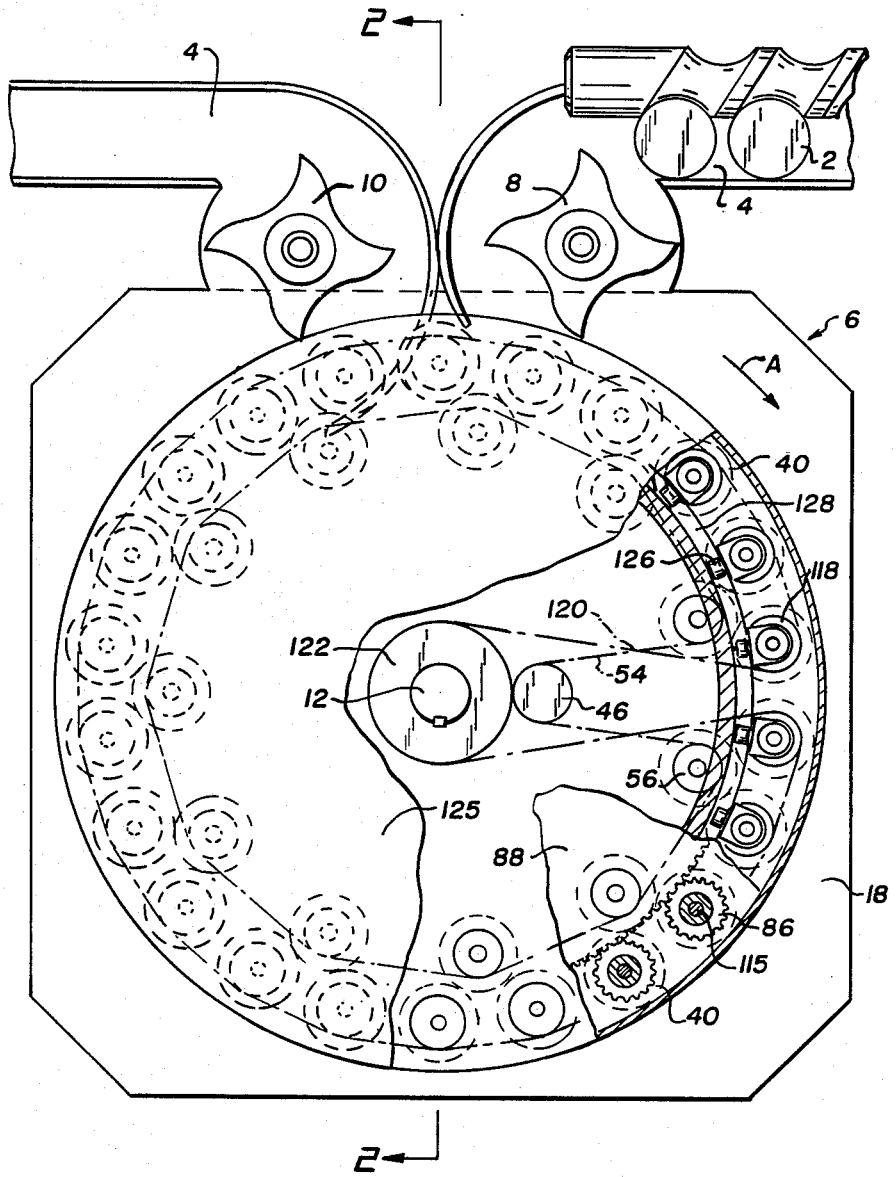
FIG. 1 is a plan view of an apparatus according to the present invention.

The drawings show an apparatus to trim the contents of a container 2 projecting from the container top. Such an apparatus would form part of a production line. As shown particularly in FIG. 1, cans 2 containing the food, particularly fish, move along a path 4 and are directed onto the apparatus 6 according to the present invention by a first star-shaped, feeding member 8. At the completion of the trimming operation the cans 2 leave the apparatus 6 by the action of a second star-shaped member 10 and continue to the next stage of the canning process.

The production line defining path 4 and the star-shaped feeding members 8 and 10 are conventional in the art.

Figure 2:
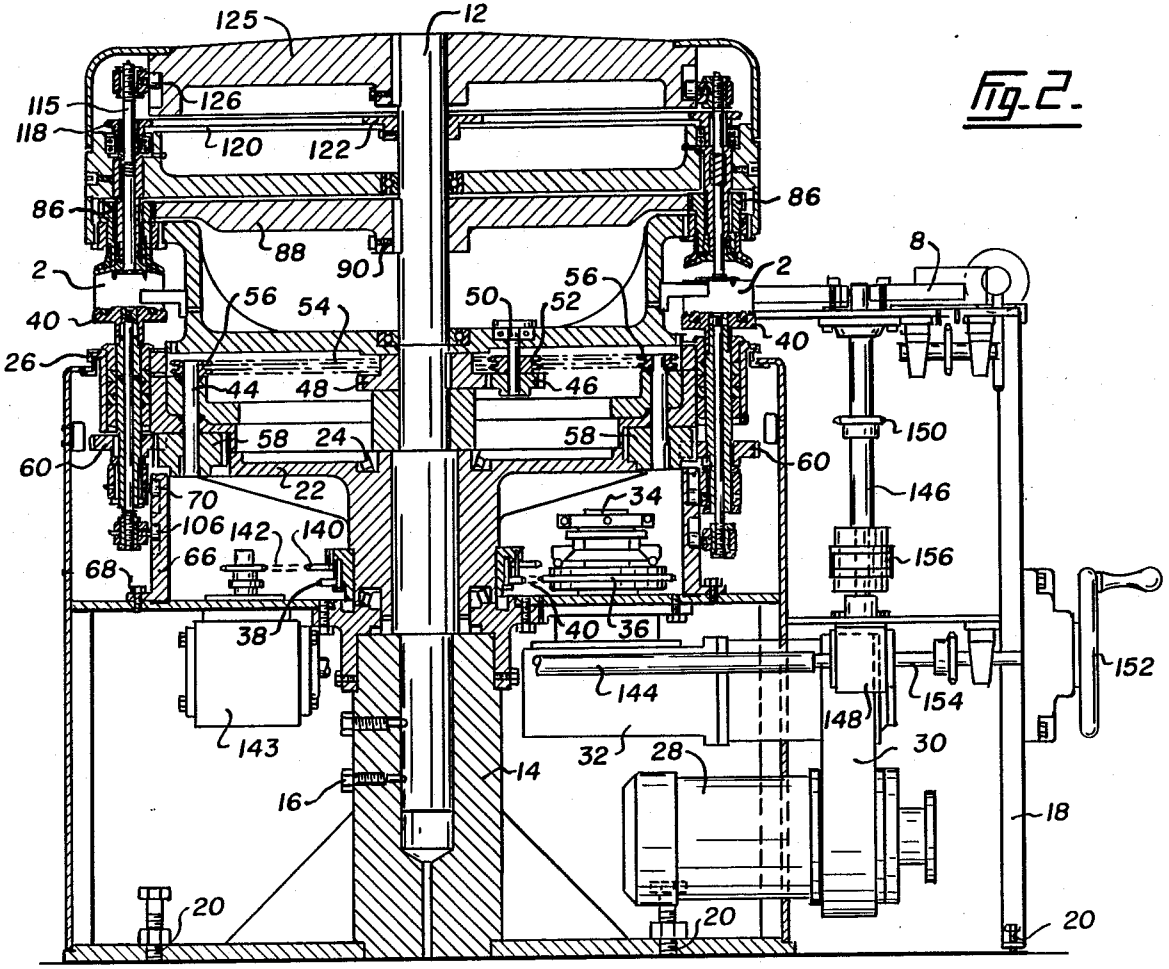
FIG. 2 is a section on the line 2—2 in FIG. 1.
Figure 3:
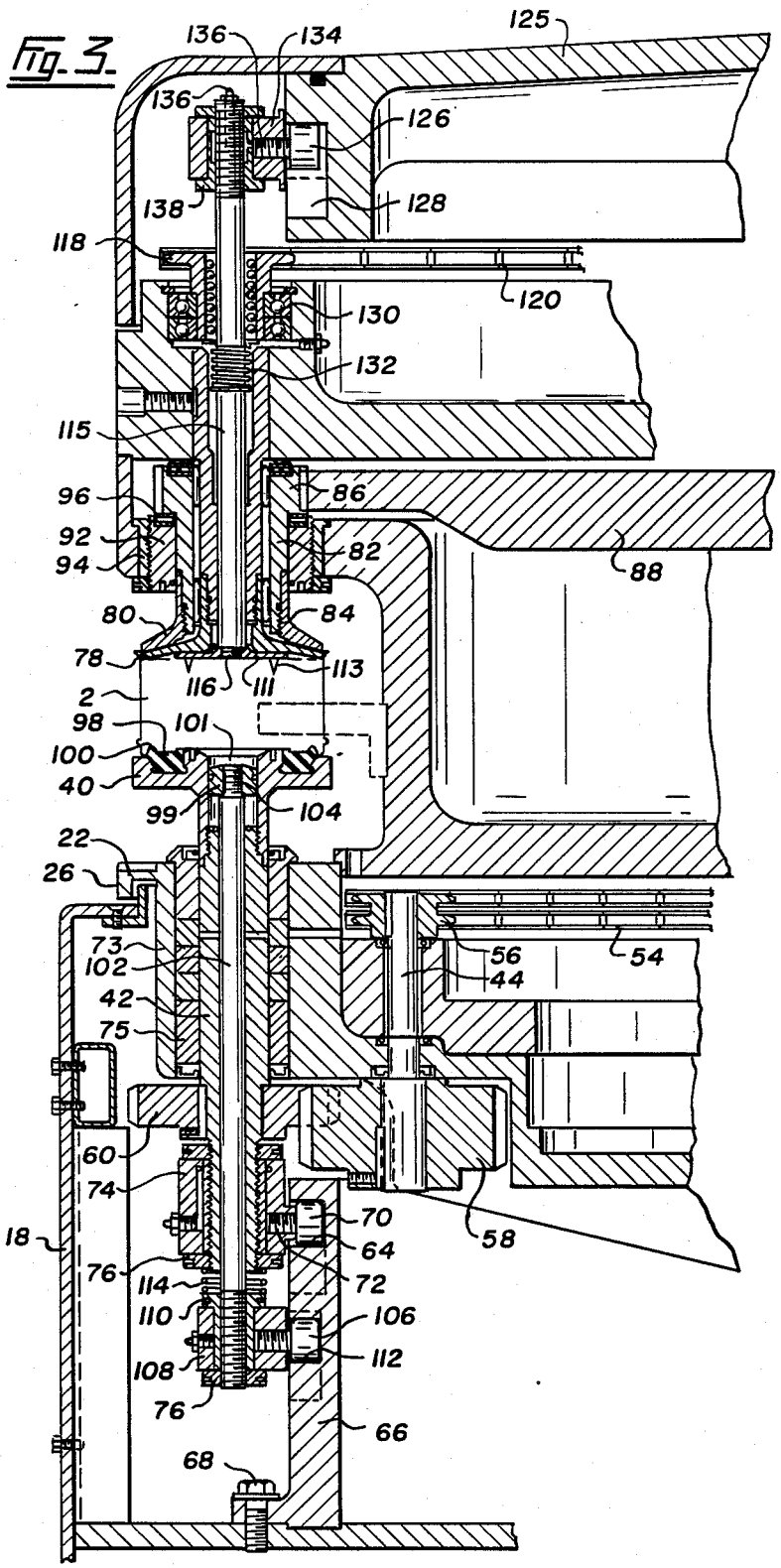
FIG. 3 is a detail, on an enlarged scale, of FIG. 2.
Figure 4:
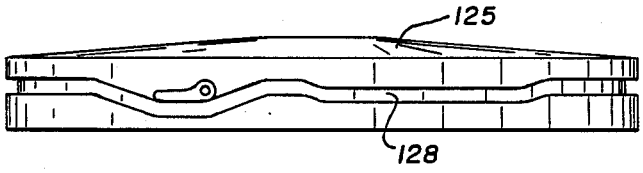
FIG. 4 shows a detail of FIG. 3.

As shown particularly in FIGS. 1 to 3 the apparatus of the invention comprises a central, fixed shaft 12. The fixed shaft 12 extends upwardly from a mount 14 and is fixed in that mount by bolts 16. The apparatus includes a frame whose members are generally designated at 18. The frame has feet 20 adapted to permit leveling of the apparatus.

The apparatus includes a table 22 rotatably mounted on the shaft 12 by a bearing 24. The table 22 extends outwardly to its outer periphery at 26. The table 22 is rotated by primary drive means. As shown in FIG. 2 the primary drive means comprises a motor 28, typically an electrical motor, driving a belt 30 to turn a gear reducer 32. The gear reducer 32 has an output shaft 34 on which is mounted a sprocket 36. There is a sprocket 38 on the table 32 and a chain 40 extends between the two sprockets 36 and 38 to rotate the table 22.

The apparatus includes a plurality of container receiving platforms 40 rotatably mounted on the table 22.

As shown particularly in FIGS. 2 and 3 the container receiving platforms 40 are each mounted on a drive shaft 42. There is a power take-off on the table 22 to rotate each drive shaft and thus each platform 40. As shown in FIGS. 2 and 3 the power take-off drives a rotatable intermediate shaft 44 through a transmission. The power take-off is a rotatable first gear wheel 46 on the table to engage a fixed gear wheel 48 on the central shaft 12. The transmission comprises a shaft 50 to receive the first gear wheel 46. There is a first sprocket 52 to rotate with the shaft 50 and a chain 54 extends from the first sprocket 52 to a plurality of second sprockets 56. There is a plurality of intermediate shafts 44 each carrying a second sprocket 56. A second gear wheel 58 is mounted on each intermediate shaft 44. There is a third gear wheel 60 on each rotatable drive shaft 42 for each platform 40 to engage a second gear wheel 58 to rotate the platforms 40 as the table 22 rotates.

Figure 5:
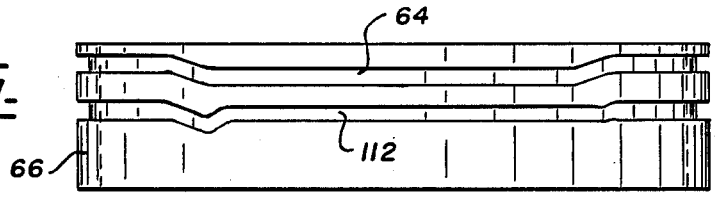
FIG. 5 shows a further detail.

There are means to lower and raise each platform 40. Such means uses drive shaft 42 extending from each platform 40. There is a first profiled track 64 adjacent the base of shaft 42 as shown particularly in FIG. 5. The track 64 is formed in a skirt 66 mounted to frame 18 at 68. A follower 70 on each shaft 42 then engages the first profiled track 64 so that the platform 40 may follow a predetermined sequence of raising and lowering as subsequently described.

As shown particularly in FIG. 3 the follower 70 is a roller bearing rotatably received on a stud 72 engaging a bush 74. The bush 74 is a bearing fit on a collar 76, which is threaded to the shaft 42. The use of flanges 76 ensures that the shaft 42 moves up and down as the follower 70 follows the track 64. The bearing fit of bush 74 on collar 76 allows rotation of the shaft 42 without interfering with the engagement of the follower 70 in the profiled track 64. The shaft 42 is located in bearings 73 in the table 22 and packed with packing members 75. The platform 40 is formed separately, purely for convenience, and is threadably attached to shaft 42 at 76.

The apparatus includes cutting means and in its preferred embodiment the cutting means comprise a pair of co-operating, relatively rotatable blades. The arrangement is shown particularly in FIG. 6 which shows a fixed, lower blade 78 and a rotatable upper blade 80. Both function in shear or scissor fashion. That is any contents of the can that project are caught between the rotating and the fixed blade and are trimmed in the manner of shears or scissors.

The rotatable blade 80 is rotated by a power take-off from the table 22. The arrangement is shown particularly in FIGS. 2 and 3 and comprises a rotatable blade shaft 82 to which the rotatable blade is threadably attached at 84. The rotatable blade shaft 82 is formed with a gear wheel 86 at its upper end to engage a gear wheel 88 fixed to the central shaft 12 at 90—see FIG. 2. The blade drive shaft is located in the bearings 92 located in threaded bush 94. Roller bearings 96 are located between the bearings 92 and the gear wheel portion 86.

The apparatus desirably includes means to prevent the container rotating relative to a platform. Again as shown particularly in FIG. 3 this means comprises a flexible seat 98, typically of rubber or neoprene, on the platform 40 to receive a container 2. There are upstanding edges 100 to the seat to ensure positive location of the container. In the preferred embodiment illustrated the means to prevent a container 2 rotating also includes means to reduce air pressure between the platform 40 and the container 2 so that ambient air pressure acts to force the container 2 onto the seal. As shown in FIG. 3 the means to reduce air pressure comprises a piston 99 in each platform 40 reciprocable in a central opening 101 in the platform. There are means to reciprocate the piston 99 comprising a piston shaft 102 to which the piston is threadably attached at 104. A piston shafts 102 extends from each piston 99. Each shaft 102 is formed with a follower 106 comprising bearing threadably attached to a bush 108 which is rotatably received on threaded bushing 110 on the piston shaft 102. There is a second profiled track 112 adjacent each piston shaft 102 and the follower 106 engages the second profiled track 112. A spring 114 is provided to ensure that the follower 106 is urged into contact with the profiled track 112. It is also functions to urge follower 70 into contact with the first profiled track 64. By the correct selection of the profile of the track 112 the follower 106 and that the piston 99 can be retracted at the appropriate time, as shown particularly in FIG. 3, and raised at the appropriate time, as shown in FIG. 2. The pressure is reduced when the piston is retracted and returned to ambient as the piston is raised.

Figure 6:
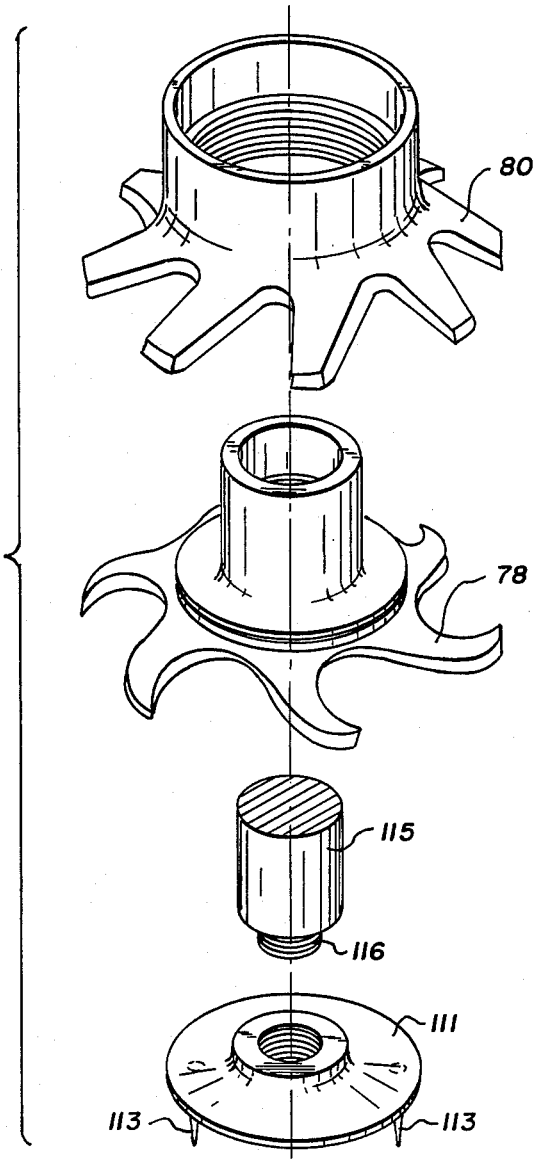
FIG. 6 illustrates the cutting means of a preferred embodiment of the invention.

In a desirable feature of the invention the apparatus includes retention means to retain the contents of the can within the can as the projecting contents are trimmed and means to prevent rotation of the contents of the can relative to the can. As shown in FIGS. 3 and 6 the retention means comprises a plate 111 to extend into each container 2. Desirably, as shown in FIG. 6, the plate 111 is formed with prongs 113 to engage the contents to assist in retention. There are means to rotate the retention means as the container rotates on the platform 40 and thus avoid relative rotation of the container 2 and the platform 40. As shown in FIG. 3 the means to rotate the retention means comprises a drive shaft 115 extending upwardly from a threaded connection 116. There is a sprocket 118 on the drive shaft 115. A chain 120 extends from the sprocket 118 on each drive shaft 115 to a fixed sprocket 122 on the central shaft 12—see FIG. 2. Thus, as the table 22 rotates, the drive shaft sprockets 118 are rotated by the chain 120 to rotate the drive shafts 115 and thus the plates 111.

Desirably the apparatus includes means to raise and lower the retention means to permit removal from and insertion of the can from and into the apparatus, that is to increase the space between the retention means and the platform 40. As shown particularly in FIG. 3 the means to raise and lower the blade comprises a third profiled track 118 adjacent drive shafts 115 formed in upper number 125. Each drive shaft 115 has a follower 126 to engage a third profiled track 128. The arrangement ensures that the plates 111 may be raised and lowered towards the platforms 40 according to a predetermined pattern.

Each drive shaft 115 is located in ball bearings 130 and a spring 132 is provided to urge the drive shaft 115 upwardly so the follower 126 remains in proper contact with the profiled track 128. The follower 126 engages a bush 134, by threaded shaft 136. The bush 134 is a rotatable, bearing fit on threaded bush 138, threaded on the upper end of drive shaft 115.

In all these followers a lubrication system greasing is provided as shown by 136.

Drive for the feeding members 8 and 10 is provided by sprocket 140 on table 32, adjacent sprocket 38. Chain 142 transmits drive from sprocket 140 to a gear reducer 143. Reducer 143 drives shaft 144, which drives vertical shaft 146 through right angle drive 148. Shaft 146 is attached to feeding member 8. Feeding member 10 driven by a power take-off sprocket 150 on shaft 146.

Manual adjustment of feeding members 8 and 10, and synchronism with feed in path 4, may be carried out by handle 152 turning shaft 154 and thus shaft 146 through clutch 156.

The apparatus functions as follows:

A can 2 moving along a production line 4 enters the apparatus by virtue of star wheel 8. As it enters the apparatus it is received on a platform 40. Immediately prior to the inlet the platform 40 is retracted, as shown in FIG. 2, and the plate 111 extended. Immediately after the can 2 is received on the platform the platform is raised, as is the plate 111, and piston 99 is retracted to reduce pressure.

The platform 40, which is rotated continuously, is raised and the plate 111 lowered. Subsequently the blades 78 and 80 are lowered and as the can moves around the table on the platform 40 in the direction of arrow A shown in FIG. 1 the knife with blade 80 rotating rapidly, trims the contents of the can and, in particular, those contents projecting from the can. After circling the table the can leaves at outlet 10.

Rotation of the table is provided by motor 28 driving belt 30 and thus gear reducer 32. Gear reducer 32 drives sprocket 36 which turns the table 22. The further sprocket 140 on the table drives shaft 144 through chain 142 to drive gear reducer 143. Shaft 144 drives shaft 146 and thus feeding members 8 and 10, the latter through sprocket 150.

The rotation of the table 22 acts to rotate gear wheel 46 on fixed gear wheel 48. As a result sprocket 52 is rotated and the chain 54 rotates sprockets 56, shafts 44 and gear wheels 58. The rotation of the gear wheels 58 drives gear wheels 60 and thus shafts 42 to rotate the platforms 40. At the same time the upper portion 88 of the table 22 is contacting gear wheels 86. This ensures rotation of the gear wheels 86, and thus rotation of the cutting blades 80. Similarly, the rotation of the table drives the sprockets 118 by the action of the chain 120 engaging the fixed central sprocket 122. As the table rotates the followers 70, 106 and 126 engage in the fixed channels 64, 112 and 128 to ensure raising and lowering of the plates 111, raising and lowering of the pistons 99 and raising and lowering of the platforms 40.

Using the apparatus of the present invention extremely rapid rates of production have been achieved coupled with extremely lower rejection rates.

I claim:

1. Apparatus to trim the contents of a container projecting from the container top, the apparatus comprising:

a central, fixed shaft;

a table rotatably mounted on the shaft;

a plurality of container receiving platforms rotatably mounted on the table;

means to raise and lower said platforms;

a flexible seat on each platform to receive a container;

a piston in each platform reciprocable relative to the platform;

means to reciprocate the piston to vary the pressure between ambient and a reduced pressure, reduction of pressure acting to prevent a container rotating relative to a platform;

a plurality of rotatable cutting means located above the table, each axially aligned with a platform;

whereby a container on said table can be rotated as the table rotates and the platform can be raised towards the cutting means to allow the cutting means to contact the container top to trim the projecting contents.

2. Apparatus as claimed in claim 1 including a primary drive means to provide rotation of all components.

3. Apparatus as claimed in claim 2 in which the primary drive means drives the table through a gear reducer having an output shaft;

a sprocket on the output shaft;

a first sprocket on the table; and a chain drive connecting said sprockets.

4. Apparatus as claimed in claim 1 in which the table has an inlet and an outlet;

means to feed containers into said inlet and out of said outlet.

5. Apparatus as claimed in claim 1 in which each container receiving platform is mounted on a rotatable drive shaft;

a power take-off on said table to rotate each drive shaft.

6. Apparatus as claimed in claim 5 in which the power take-off drives the said rotatable drive shafts through a transmission.

7. Apparatus as claimed in claim 6 in which the power take-off is a rotatable first gear wheel on said table to engage a first fixed gear wheel on said central shaft to rotate said first gear wheel.

8. Apparatus as claimed in claim 7 in which the transmission is a first shaft to receive said first gear wheel;

a first sprocket to rotate with said shaft;

a chain extending from said first sprocket to a plurality of second sprockets;

a plurality of second shafts, each mounting a second sprocket;

a second gear wheel on each second shaft;

a third gear wheel on each rotatable drive shaft for each platform to engage a second gear wheel to rotate the platform as the wheel rotates.

9. Apparatus as claimed in claim 1 in which the means to raise and lower each platform comprises:

a platform shaft extending from each platform;

a profiled track adjacent said platform shafts;

a follower on each platform shaft to engage the profiled track whereby the platform may follow a predetermined sequence of raising and lowering.

10. Apparatus as claimed in claim 1 in which each cutting means comprises a pair of co-operating, relatively movable, blades.

11. Apparatus as claimed in claim 10 in which there is a fixed blade and a rotatable blade.

12. Apparatus as claimed in claim 11 in which the rotatable blade is rotated by a power take-off from the table.

13. Apparatus as claimed in claim 12 in which the rotatable blade is located on a rotatable blade drive shaft;

a gear wheel on each rotatable blade drive shaft;

a gear wheel on said central shaft to engage each gear wheel on each rotatable blade drive shaft;

whereby the gear wheel on each rotatable blade drive shaft is rotated as it moves around the gear wheel on said central shaft as the table rotates.

14. Apparatus as claimed in claim 1 in which the means to reciprocate said piston comprises a piston shaft extending from each piston;

a profiled track adjacent said piston shafts;

a follower on each piston shaft to engage said profiled track whereby the piston may be retracted from the platform to reduce pressure.

15. Apparatus as claimed in claim 1 including retention means to retain the contents of the container within the container as the projecting contents are trimmed.

16. Apparatus as claimed in claim 15 in which the retention means comprises a plate to extend into each container.

17. Apparatus as claimed in claim 16 including prongs on each plate to engage the contents to assist in retention.

18. Apparatus as claimed in claim 15 including means to rotate the retention means as the container rotates on the platform.

19. Apparatus as claimed in claim 18 in which means to rotate the retention means comprises a retention means drive shaft;

a retention means drive sprocket on said central shaft;

a sprocket on each retention means drive shaft;

a chain to extend around said sprockets whereby as the table rotates about the retention means the drive shafts are rotated.

20. Apparatus as claimed in claim 19 including means to raise and lower the retention means to allow removal of the container.

21. Apparatus as claimed in claim 20 in which the means to raise and lower the retention means comprises a profiled track adjacent the retention means drive shafts;

a follower on each retention means drive shaft to engage said profiled track whereby the retention means may be raised and lowered relative to the platforms according to a predetermined pattern.

22. Apparatus to trim the contents of a container projecting from the container top, the apparatus comprising:

a central, fixed shaft;

a table rotatably mounted on the shaft;

a plurality of container receiving platforms rotatably mounted on the table;

means to raise and lower said platforms;

a rotatable first gear wheel on said table;

a first fixed gear wheel on said central shaft to engage said first rotatable gear wheel on said table;

a first shaft to receive said first rotatable gear wheel;

a first sprocket to rotate with said first shaft;

a plurality of second shafts;

a plurality of second sprockets, each mounted on a second shaft;

means to transfer drive from said first sprocket to said second sprocket;

a second gear wheel on each second shaft;

a third gear wheel on each rotatable drive shaft for each platform to engage a second gear wheel to rotate the platform as a wheel rotates.

23. Apparatus to trim the contents of a container projecting from the container top, the apparatus comprising:

a central, fixed shaft;

a table rotatably mounted on the shaft;

a plurality of container receiving platforms rotatably mounted on the table;

means to raise and lower said platforms;

a plurality of cutting means located above the table, each cutting means axially aligned with a platform and comprising a fixed blade and rotatable blade;

a plurality of rotatable blade drive shafts, each carrying a rotatable blade;

a gear wheel on each rotatable blade drive shaft;

a gear wheel on said central shaft to engage each gear wheel on each rotatable blade drive shaft;

whereby the gear wheel on each rotatable blade drive shaft is rotated as it moves around the gear wheel on said central shaft as the table rotates.

24. Apparatus to trim the contents of a container projecting from the container top, the apparatus comprising:

a central, fixed shaft;

a table rotatably mounted on the shaft;

a plurality of container receiving platforms rotatably mounted on the table;

means to raise and lower said platforms;

a retention means to retain the contents of the container within the container as the projecting contents are in trim;

a means to rotate the retention means as the container rotates on the platform;

said means to rotate retention means comprising a rotation means drive shaft;

a retention means drive sprocket on said central shaft;

a sprocket on each retention means drive shaft;

means to transmit drive from said retention means drive sprocket to said sprockets on the drive shaft whereby as the table rotates about the retention means the drive shafts are rotated.

25. Apparatus as claimed in claim 24, including means to raise and lower the retention means to allow removal of the container.

26. Apparatus as claimed in claim 25, in which the means to raise and lower the retention means comprise a profile of track adjacent the retention means drive shaft;

follower on each retention means drive shaft to engage said profile track whereby the retention means may be raised and lowered relative to the platform according to a predetermined pattern.

* * * * *